US006250991B1

(12) United States Patent
Afif

(10) Patent No.: US 6,250,991 B1
(45) Date of Patent: Jun. 26, 2001

(54) BEARING SUBSTITUTE FOR WAFER POLISHING ARM

(75) Inventor: Samir A. Afif, Alburtis, PA (US)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

(21) Appl. No.: 09/419,453

(22) Filed: Oct. 15, 1999

(51) Int. Cl.[7] ..... B24B 1/00

(52) U.S. Cl. ..... 451/41; 451/287; 451/285; 384/549

(58) Field of Search ..... 451/41, 285, 287, 451/397, 398, 365; 384/549, 908, 909

(56) References Cited

U.S. PATENT DOCUMENTS 4,934,107 * 6/1990 MacKay, Jr. ..... 451/287
4,991,356 * 2/1991 Ono ..... 451/285
5,001,869 * 3/1991 Hutchins ..... 451/285
5,085,012 * 2/1992 Hutchins ..... 451/285
5,649,849 * 7/1997 Pileri et al. ..... 451/285

* cited by examiner

*Primary Examiner*—Derris H. Banks
*Assistant Examiner*—Lee Wilson
(74) *Attorney, Agent, or Firm*—Duane Morris & Heckscher LLP

(57) ABSTRACT

An apparatus and method for polishing a workpiece including a polishing pad, and at least one polishing arm for holding a workpiece to be polished on the polishing pad. The polishing arm includes at least one plastic bearing. The plastic bearing prevents lock up of a vacuum chuck coupled to the polishing arm because it is impervious to slurry which often becomes lodged in conventional ball bearings.

21 Claims, 6 Drawing Sheets

BEARING SUBSTITUTE FOR WAFER POLISHING ARM

FIELD OF THE INVENTION

The present invention relates to fabrication of semiconductor devices, and in particular, to a method and apparatus for polishing semiconductor wafers.

DESCRIPTION OF THE RELATED ART

Chemical mechanical planarization ("CMP") processes remove material from the surface of a semiconductor wafer in the production of ultra-high density integrated circuits. In a typical CMP process, a wafer is pressed against a polishing pad in the presence of a slurry under controlled chemical, pressure, velocity, and temperature conditions. The slurry solution generally contains small, abrasive particles that abrade the surface of the wafer, and chemicals that etch and/or oxidize the surface of the wafer. The polishing pad is generally a planar pad made from a relatively soft, porous material such as polyurethane. Thus, when the pad and/or the wafer moves with respect to the other, material is removed from the surface of the wafer by the abrasive particles (mechanical removal) and by the chemicals (chemical removal) in the slurry.

FIGS. 1 and 2 show a conventional polishing apparatus 10. The apparatus 10 includes a polishing pad 20 and three polishing stations 30, 40, 50 for polishing semiconductor wafers 60. Preferably, the polishing pad 20 spins counter-clockwise to accomplish the polishing of the wafers 60, as shown by directional arrow A in FIG. 2. Each station 30, 40, 50 includes a polishing arm 31, 41, 51 which holds the wafers 60 during the polishing process. Each polishing arm 31, 41, 51 includes a U-shaped member for holding vacuum chucks 32, 42, 52. Each polishing arm 31, 41, 51 includes one such vacuum chuck 32, 42, 52. The vacuum chucks 32, 42, 52 are coupled to U-shaped members through metal bearings 35, 45, 55. The bearings 35, 45, 55 allow the vacuum chucks 32,42, 52 to rotate with respect to the respective polishing arms 31, 41, 51. The vacuum chucks 32, 42, 52 operate to hold the wafers 60 during the polishing process. Each of the vacuum chucks 32, 42, 52 includes an upper end 33, 43, 53 which may be coupled to a vacuum device (not shown) to provide a vacuum to the vacuum chucks. The polishing apparatus 10 also includes a slurry dispenser 70 which produces slurry which is dispensed onto a top surface 21 of the polishing pad 20.

A problem associated with the conventional apparatus 10 discussed above is that the slurry dispensed from slurry dispenser 70 often becomes disposed in the metal bearings 35, 45, 55 which couple the vacuum chucks 32, 42, 52 to the polishing arms 31, 41, 51. The slurry often causes the metal bearings 35, 45, 55 to "lock up", thereby preventing the free rotation of the chucks 32, 42, 52 about the polishing arms 31, 41, 51. The locking up of the metal bearings 35, 45, 55 results in uneven polishing of the wafers 60 attached to the polishing arms 31, 41, 51.

Therefore, there is currently a need for an improved polishing apparatus which substantially reduces the possibility of lock up of the bearings of the polishing apparatus.

SUMMARY OF THE INVENTION

The present invention is an apparatus and method for polishing a workpiece including a polishing pad, and at least one polishing arm for holding a workpiece to be polished on the polishing pad, the polishing arm including at least one plastic bearing.

The above and other advantages and features of the present invention will be better understood from the following detailed description of the preferred embodiments of the invention which is provided in connection with the accompanying drawings.

BRIEF DESCRIPTION OF THE DRAWINGS

FIG. 3(*b*) is a side elevation view of the plastic bearing shown in FIG. 3(*a*).

DETAILED DESCRIPTION

Figure 3A:
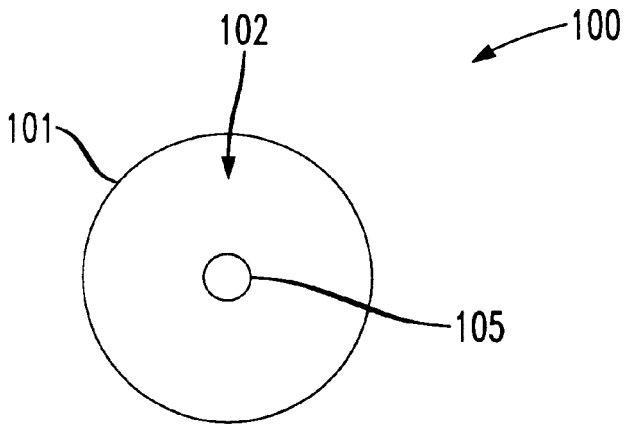
FIG. 3(*a*) is a top plan view of a plastic bearing according to the exemplary embodiment of the present invention.
Figure 3B:
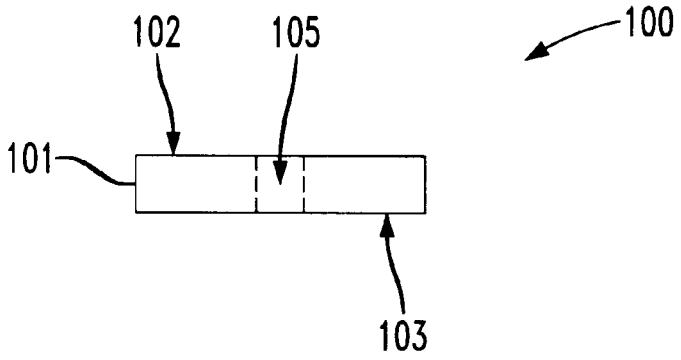

Referring to FIGS. 3(*a*) and 3(*b*), there is shown a plastic bearing 100 according to an exemplary embodiment of the present invention. The bearing includes a substantially cylindrical member 101 with no external openings except for a substantially cylindrical longitudinal opening 105 formed therein which extends from a top side 102 of the bearing to a bottom side 103 of the bearing. The bearing may be made of any suitable plastic material, however, polytetrafluoroethylene (sold under the trademark TEFLON®) is preferred.

Because the bearing 100 has no external openings (other than the longitudinal opening 105), there are no openings into which foreign materials (e.g. slurry) can penetrate the bearing. Thus, the reliability of the bearing 100 is increased relative to metal bearings, such as ball bearings.

Figure 4:
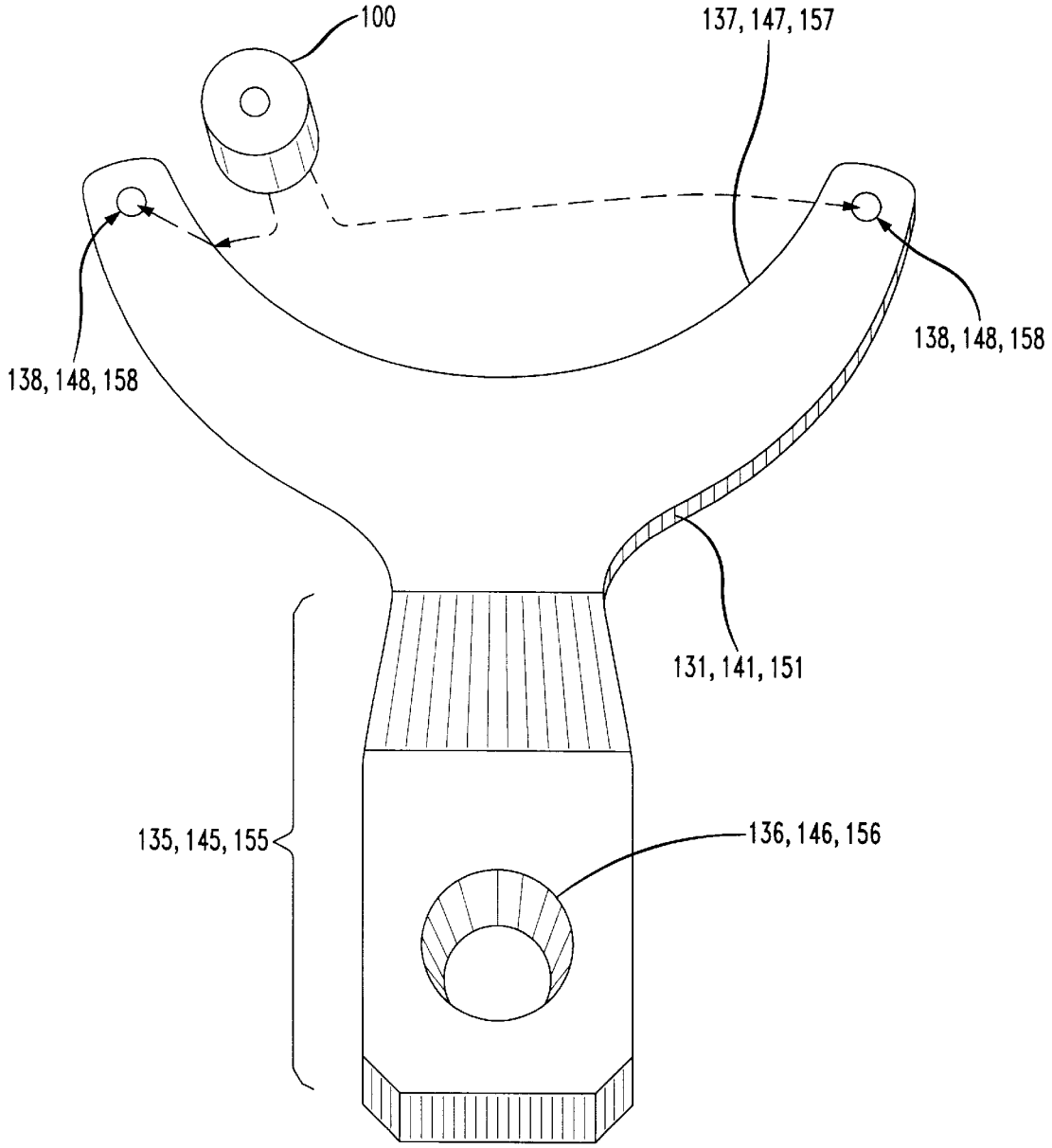
FIG. 4 is an isometric view of a polishing arm including the bearing shown in FIGS. 3(*a*) and 3(*b*).

FIG. 4 is an isometric view of a polishing arm 131, 141, 151 including the plastic bearing 100 according to the exemplary embodiment of the present invention. The polishing arm 131, 141, 151 includes an extension member 135, 145, 155 with an opening 136, 146, 156 disposed therein for coupling the polishing arm to a polishing apparatus 110 (see FIGS. 5 and 6). The polishing arm 131, 141, 151 also includes a U-shaped member 137, 147, 157 with openings 138, 148, 158 disposed therein for receiving bearings, such as bearing 100 described above. The openings 138, 148, 158 and the bearings (e.g. bearing 100) serve to couple the polishing arm 131, 141, 151 to at least one vacuum chuck 132, 142, 152 (see FIG. 6). Preferably, each polishing arm 131, 141, 151 is coupled to two vacuum chucks 132, 142, 152.

Figure 5:
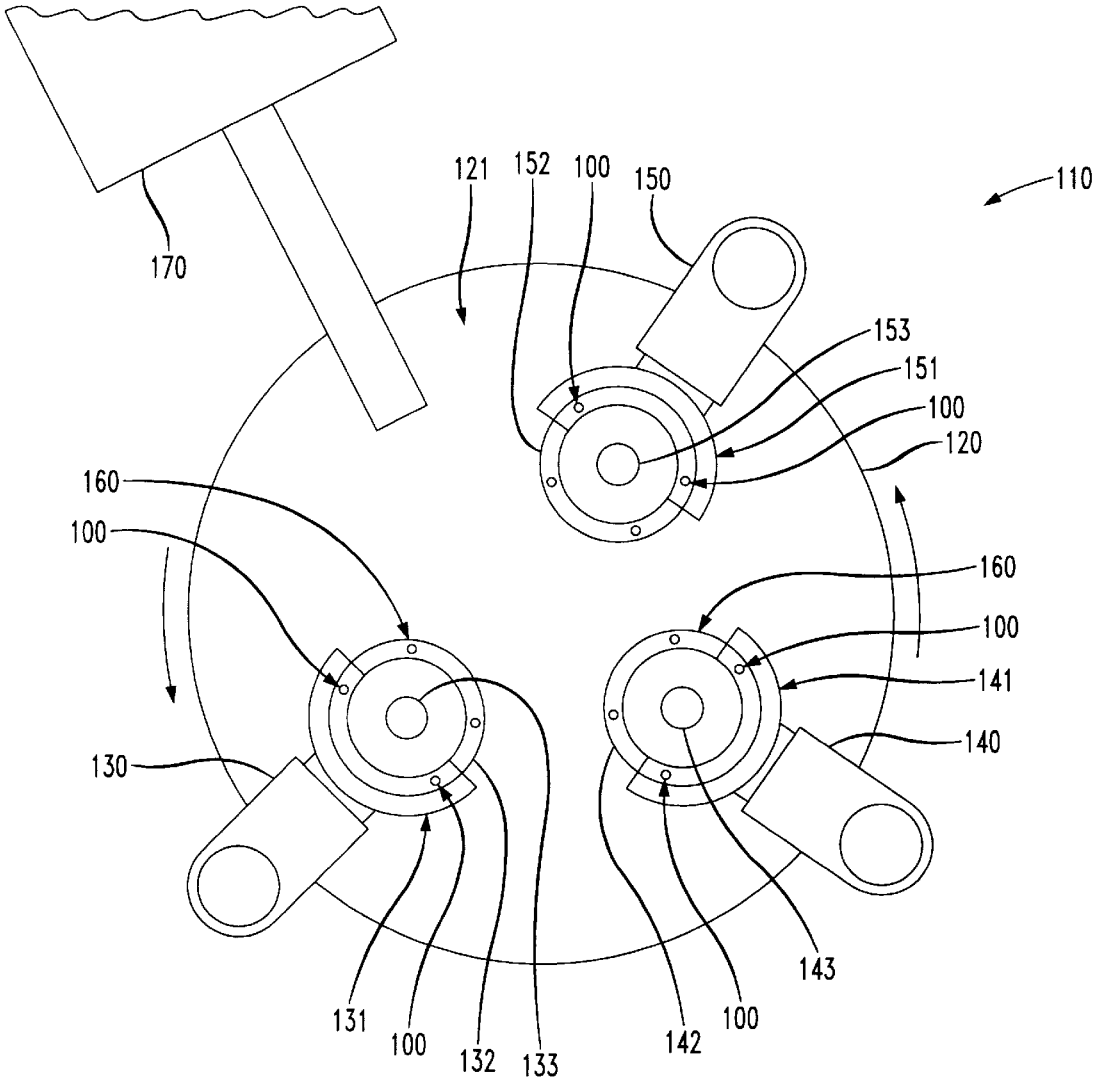
FIG. 5 is a top plan view of a polishing apparatus according to an exemplary embodiment of the present invention utilizing the plastic bearing shown in FIGS. 3(*a*) and 3(*b*).
Figure 6:
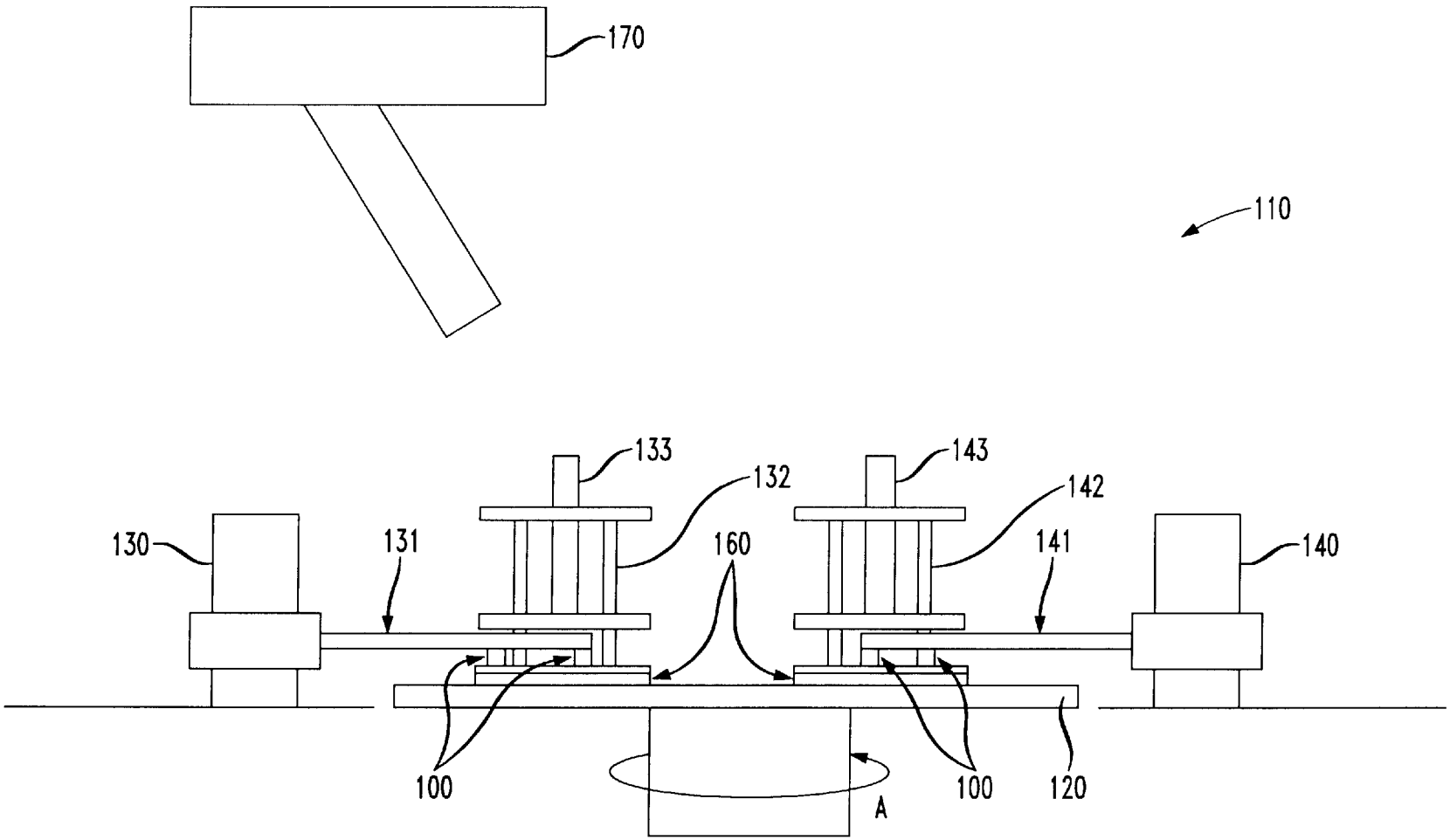
FIG. 6 is a side elevation view of the polishing apparatus shown in FIG. 5.

FIGS. 5 and 6 show a polishing apparatus 110 according to an exemplary embodiment of the present invention. The apparatus 110 includes a polishing pad 120 and three polishing stations 130, 140, 150 (each including bearings 100 as described above with reference to FIGS. 3(*a*) and 3(*b*)) for polishing semiconductor wafers 160. Preferably, the polishing pad 120 spins counter-clockwise to accomplish the polishing of the wafers 160, as shown by directional arrow A in FIG. 6. Each station 130, 140, 150 includes a polishing arm 131, 141, 151 which holds the wafers 160 during the polishing process. Each polishing arm 131, 141, 151 includes a U-shaped member for holding vacuum chucks 132, 142, 152. Each polishing arm 131, 141, 151 includes one such vacuum chuck 132, 142, 152. The vacuum chucks 132, 142, 152 are coupled to U-shaped members through plastic bearings 100 described above. The bearings 100 allow the vacuum chucks 132, 142, 152 to rotate with respect to the respective polishing arms 131, 141, 151. The vacuum chucks 132, 142, 512 operate to hold the wafers 160 during the polishing process. Each of the vacuum chucks 132, 142, 152 includes an upper end 133, 143, 153 which may be coupled to a vacuum device (not shown) to provide a vacuum to the vacuum chucks. The polishing apparatus 110 also includes a slurry dispenser 170 which produces slurry which is dispensed onto a top surface 121 of the polishing pad 120.

Figure 1:
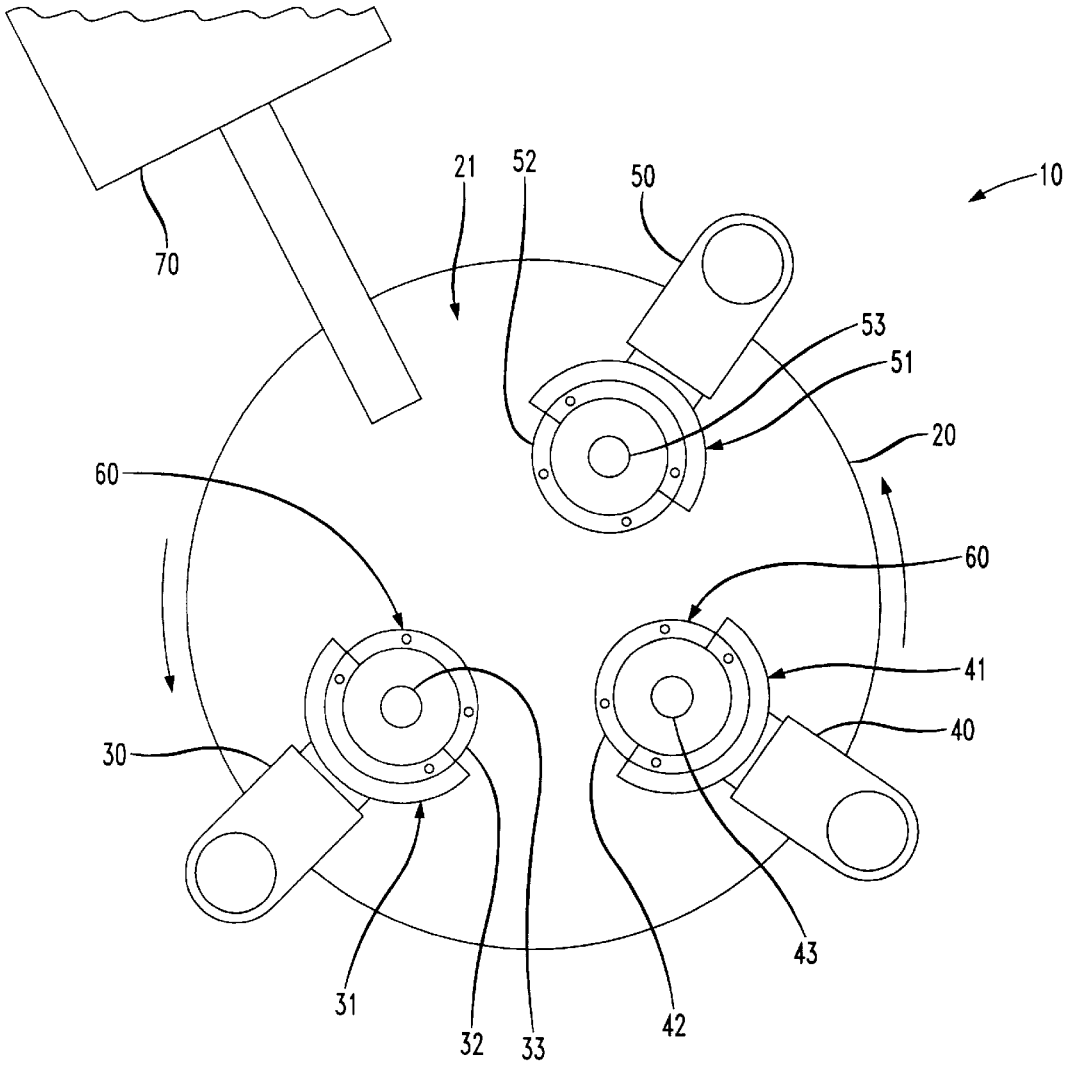
FIG. 1 PRIOR ART
FIG. 1 is a top plan view of a conventional polishing apparatus.
Figure 2:
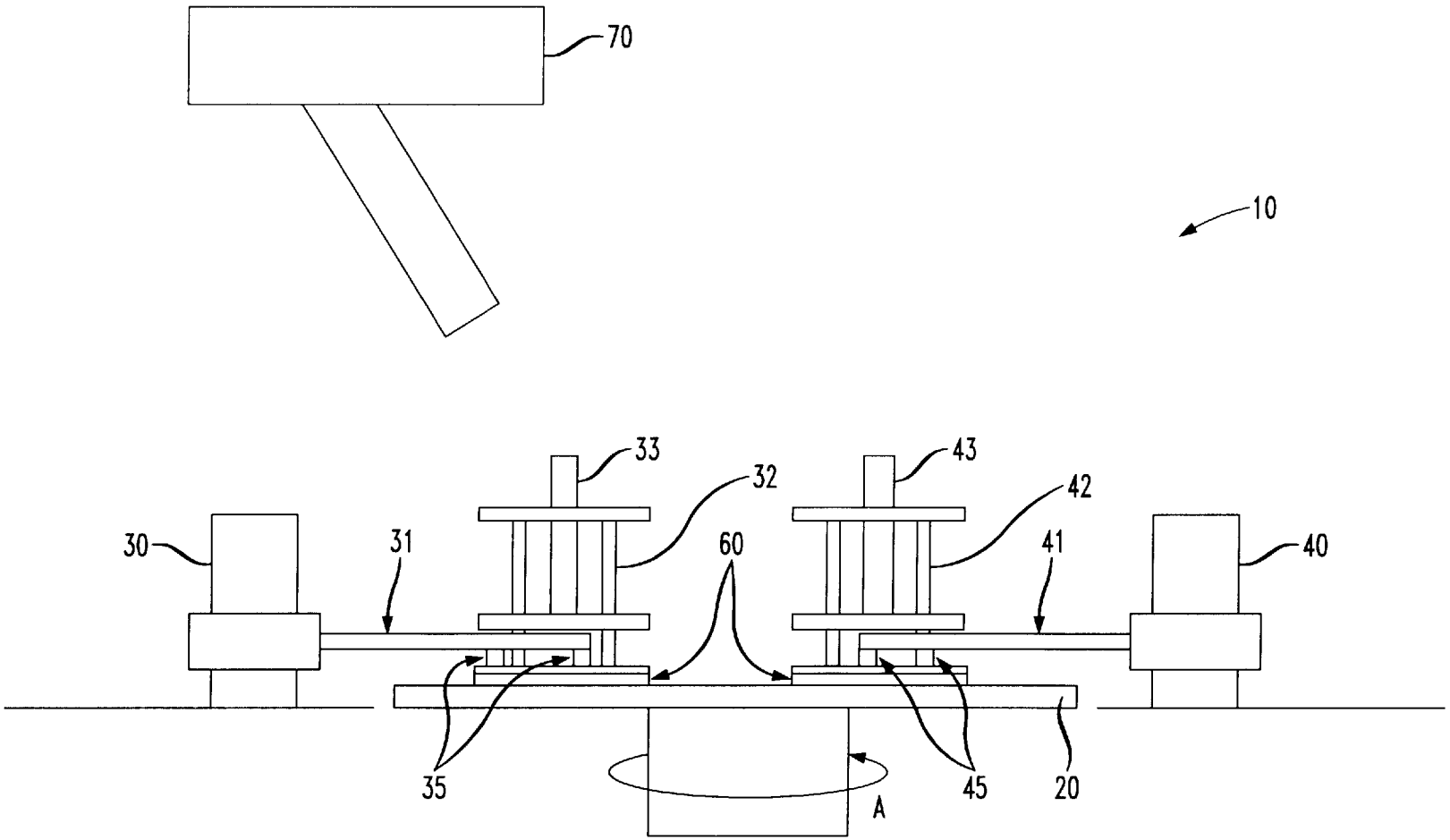
FIG. 2 PRIOR ART
FIG. 2 is a side elevation view of the conventional polishing apparatus shown in FIG. 1.

The polishing apparatus 110 described above substantially limits the "lock up" problems experienced by conventional apparatus (e.g. apparatus 10 shown in FIG. 1). For example, the metal bearings of conventional apparatus (e.g. apparatus 10) can "lock up" (i.e. prohibit rotation) due to slurry which becomes lodged in the bearings during the polishing process. Since the above apparatus 110 utilizes plastic bearings 100 (rather than metal bearings used in the conventional apparatus 10) in the polishing arms 131, 141, 151, the slurry dispensed by slurry dispenser 170 does not cause "lock up" of the bearings should it become lodged therein. The plastic bearings 100 are unaffected by the slurry, and therefore rotates normally even in the presence of the slurry. Accordingly, the polishing apparatus 110 of the exemplary embodiment of the present invention lasts longer and requires less maintenance than conventional apparatus.

Although the polishing apparatus 110 described above has been described as having three polishing stations 130, 140, 150, it should be noted that the plastic bearing 100 and polishing arm of the exemplary embodiment of the present invention can be used in a polishing apparatus including only one or any plurality of polishing stations. Further, although the polishing arms (e.g. polishing arm 131) described above include an extension member (e.g. extension member 135) and a U-shaped member (e.g. U-shaped member 137), the polishing arm of the exemplary embodiment of the present invention may be of any shape known to those skilled in the art, as long as the polishing arm includes bearings. Additionally, although the polishing pad 120 of the polishing apparatus 110 is described above as preferably rotating counter-clockwise, the polishing pad may also rotate clockwise without departing from the scope of the invention.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. An apparatus for polishing a workpiece comprising:

a polishing pad;

at least one polishing arm for holding a workpiece to be polished on the polishing pad, said at least one polishing arm including at least one plastic bearing; and, a slurry dispenser, said slurry dispenser providing slurry to a surface of the polishing pad.

2. The apparatus of claim 1, wherein the plastic bearing comprises a substantially cylindrical body having a longitudinal opening therethrough.

3. The apparatus of claim 2, wherein the plastic bearing has no external opening except the longitudinal opening.

4. The apparatus of claim 1, wherein the bearing is made of polytetrafluoroethylene.

5. The apparatus of claim 1, wherein the at least one polishing arm comprises two polishing arms.

6. The apparatus of claim 1, wherein the at least one plastic bearing comprises two plastic bearings, said plastic bearings disposed at opposite ends of the at least one polishing arm.

7. The apparatus of claim 6, wherein the at least one polishing arm comprises an extension member coupled to a U-shaped member, said two plastic bearings disposed at opposite ends of the U-shaped member.

8. The apparatus of claim 1, wherein the at least one polishing arm comprises an extension member coupled to a U-shaped member.

9. The apparatus of claim 1, wherein the at least one polishing arm includes at least one vacuum chuck coupled thereto.

10. A semiconductor wafer polishing apparatus comprising:

a polishing pad;

at least one polishing arm for holding a workpiece to be polished on the polishing pad, said at least one polishing arm including at least one plastic bearing; and, a slurry dispenser said slurry dispenser providing slurry to a surface of the polishing pad.

11. The apparatus of claim 10, wherein the plastic bearing comprises a substantially cylindrical body having a longitudinal opening therethrough.

12. The apparatus of claim 11, wherein the plastic bearing has no external opening except the longitudinal opening.

13. The apparatus of claim 10, wherein the bearing is made of polytetrafluoroethylene.

14. The apparatus of claim 10, wherein the at least one polishing arm comprises two polishing arms.

15. The apparatus of claim 10, wherein the at least one plastic bearing comprises two plastic bearings, said plastic bearings disposed at opposite ends of the at least one polishing arm.

16. The apparatus of claim 15, wherein the at least one polishing arm comprises an extension member coupled to a U-shaped member, said two plastic bearings disposed at opposite ends of the U-shaped member.

17. The apparatus of claim 10, wherein the at least one polishing arm comprises an extension member coupled to a U-shaped member.

18. The apparatus of claim 10, wherein the at least one polishing arm includes at least one vacuum chuck coupled thereto.

19. A method for polishing at least one workpiece, comprising the steps of:

disposing at least one polishing arm about a polishing pad;

disposing at least one plastic bearing in the at least one polishing arm; and, polishing at least one workpiece using the at least one polishing arm and a chemical slurry.

20. The method of claim 19, comprising the further step of:

contacting the at least one workpiece with the polishing pad to polish the at least one workpiece.

21. The method of claim 19, wherein the at least one workpiece comprises a semiconductor wafer.

* * * * *